US007160200B2

(12) United States Patent
Grober

(10) Patent No.: US 7,160,200 B2
(45) Date of Patent: Jan. 9, 2007

(54) GOLF SWING TEMPO MEASUREMENT SYSTEM

(75) Inventor: Robert D Grober, Milford, CT (US)

(73) Assignee: Yale University, New Haven, CT (US)

( * ) Notice: Subject to any disclaimer, the term of this patent is extended or adjusted under 35 U.S.C. 154(b) by 0 days.

(21) Appl. No.: 10/948,374

(22) Filed: Sep. 22, 2004

(65) Prior Publication Data

US 2006/0063600 A1 Mar. 23, 2006

(51) Int. Cl.
*A63B 53/16* (2006.01)

(52) U.S. Cl. ..... 473/234; 473/234

(58) Field of Classification Search ..... 473/131, 473/213, 221, 224, 233–234
See application file for complete search history.

(56) References Cited

U.S. PATENT DOCUMENTS 5,233,544 A * 8/1993 Kobayashi ..... 702/141
5,694,340 A 12/1997 Kim
5,951,410 A 9/1999 Butler et al.
6,045,364 A 4/2000 Dugan et al.
6,192,323 B1 2/2001 Boehm
6,224,493 B1 5/2001 Lee et al.
6,261,102 B1 7/2001 Dugan et al.
6,385,559 B1 5/2002 Boehm
6,402,634 B1 6/2002 Lee et al.
6,441,745 B1 8/2002 Gates
6,490,542 B1 12/2002 Boehm
6,567,536 B1 5/2003 McNitt et al.
6,602,144 B1 8/2003 Manwaring et al.
6,607,450 B1 8/2003 Hackman
6,611,792 B1 8/2003 Boehm
6,638,175 B1 10/2003 Lee et al.
6,648,769 B1 11/2003 Lee et al.
6,658,371 B1 12/2003 Boehm et al.
6,746,247 B1 6/2004 Barton

* cited by examiner

*Primary Examiner*—Kim Nguyen
(74) *Attorney, Agent, or Firm*—Carmody & Torrance LLP

(57) ABSTRACT

A biofeedback system including an elongated member, for feeding back sounds indicative of swing tempo of the elongated member is provided. The system comprises a plurality of acceleration measuring devices adapted to measure accelerations at a plurality of locations along the elongated member; a first microcontroller for processing the measured acceleration signals to reduce effects of gravity and forming a digital number related to an angular rotational speed raised to a power; said digital number comprising a plurality of bits; a second microcontroller for receiving the digital number and associating the bits with a plurality of groups each having an associated tonal composition and amplitude value indicative of bit content and for forming commands indicative of the tonal composition and amplitude value; and a synthesizer responsive to commands and producing an audio signal; and an output for outputting the audio signal.

10 Claims, 6 Drawing Sheets

GOLF SWING TEMPO MEASUREMENT SYSTEM

BACKGROUND OF THE INVENTION

1. Field of the Invention

This invention relates to a device for providing audio biofeedback associated with the motion or tempo of a golf swing.

2. Background of the Invention

An important key to a reproducible swing, whether in golf, tennis, fishing, bowling, baseball, etc. is consistent tempo; once the player gets the correct swing for a given game situation, he/she must be able to repeat the swing in the same situation. A consistent tempo indicates that speed variations throughout the swing are repeated from swing to swing.

Perception of the tempo in a swing is generally very difficult in sports. An athlete's perception of fast and slow can vary from day to day, moment to moment, depending on mood, level of adrenaline, etc. Achieving consistent performance is further complicated by the fact that visual aids generally require diversion of attention away from more crucial focal points. Moreover, training is generally focused on tactile and visual perception by an observer other than the athlete and communicating problems with swing speed variation and tempo is difficult. Therefore finding a quantitative method of perceiving tempo, which does not interfere with the action of the swing, would be a useful athletic training/performance aid.

A natural pathway for perceiving tempo is through sound and music and has the advantage that the player can focus on his/her swing. Through extensive exposure to music, which is universal in all cultures, we are sensitized to the timing associated with tempo from an acoustic sensory perspective.

The instantaneous motions in a golf swing occur faster than one can consciously control, yet controlled speed and tempo are crucial to successful, reproducible performance. Further, muscle memory, which yields an unconscious coordination of muscle activity, can be learned by repetitive practice of a correct tempo. The auditory pathway is therefore an excellent mechanism for subconsciously providing swing tempo information without distracting the athlete.

A golf swing's tempo indicates the speed variation of the golf club as it traverses a circular route between the back swing, through impact with the ball and the follow through. Since a golf swing is dominated by motion in a circular path, the tempo of the swing is indicative of the time history, or tempo of the club's angular speed. Moreover, since the centripetal acceleration of a body traveling in a circular motion is a function of the angular velocity of the body, accelerometers mounted near a golf club head provide signals, which can be used to indicate tempo.

The centripetal acceleration at a particular point on a swinging club can be measured with an accelerometer at the point of interest and whose sensing axis is aligned along the axis of the shaft. In general, this centripetal acceleration, $a_c$, can be used to yield an instantaneous measurement of the angular velocity squared of the club through the relation $a_c=\omega^2 r$, where $\omega$ is the angular velocity of the club shaft and r is the effective radius through which the accelerometer is moving.

The prior art appears to have recognized that measurement errors can occur due to the influence of gravity. The error signal, which can be confused with a desired centripetal acceleration signal, may be reduced or eliminated by making a differential measurement using two accelerometers located at different positions along the axis of the shaft; each accelerometer senses identical gravitational acceleration, but the centripetal acceleration scales as the effective radius of motion.

However, being able to fully benefit from accelerometers mounted on a golf club and the use of audio feedback has been somewhat elusive, but not for a lack of effort. For example, U.S. Pat. No. 6,261,102 describes converting the accelerometer output into an audio signal for biofeedback. With the axis of an accelerometer along the axis of the club, it measures the centripetal acceleration and from that value determines the square of the club's angular velocity. A signal proportional to the square of the club's angular velocity is then converted to frequency and fed to the person as an audio signal. Unfortunately, there is a perceived deficiency in its lack of compensating for the effects of gravity and tendency to create unpleasant "chirp like" sounds because of the large speed changes during a golf swing.

Two other relevant prior art patents suffer from similar deficiencies. Specifically, U.S. Pat. No. 5,233,544 to Kobayashi, while describing the use of multiple accelerometers along the golf club shaft, fails to recognize a potential for sound quality problems nor does he describe or suggest the use of multiple tones as provided in the present invention. Further, Kobayashi uses an angular velocity signal rather than an angular velocity squared signal and therefore does not provide for the sensitivity benefits of the velocity squared signal.

U.S. Pat. No. 5,694,340, to Kim, likewise describes the use multiple accelerometers to develop acceleration signals but fails to describe, suggest or appreciate the benefits of multiple accelerometers to cancel deleterious effects of gravity. Further, although Kim does use multiple frequencies, these different frequencies are used to distinguish between three axes and not to eliminate chirp or improving the tonal quality of the sound.

Accordingly, further advancements in the art are desirable. In particular, it would be desirable to provide a biofeedback system for a piece of athletic equipment, such as by way of example and not limitation, a golf club, that eliminates or at least reduces the effect of linear accelerations (not due to rotational motion) such as gravity that occur along the axis of the golf club and uses the angular velocity squared signal for increased sensitivity and improved sonification to produce pleasing sounds whose tonal composition and amplitude changes to indicate tempo. The present invention overcomes the foregoing deficiencies while achieving the objectives and advantages set forth herein.

OBJECTIVES AND SUMMARY OF THE INVENTION

It is thus an objective of the present invention to overcome the perceived deficiencies in the prior art.

It is another objective of the present invention to provide an improved arrangement of measurement devices that are used to cancel the effects of gravity, thus providing an improved indicator of swing tempo.

It is another objective of the present invention to provide improved sensitivity for measuring changes in tempo by using a signal related to the angular velocity squared signal.

Another objective of the present invention is to provide improved audio feedback using tonal composition and amplitude characteristics that are pleasing to the ear.

Yet another objective of the present invention is to provide a system in which measured signals or information and commands derived from the measured signals can be stored for later playback and analysis.

Still another objective of the present invention is to provide an improved audio feedback path that utilizes a wireless link for carrying the biofeedback signal.

Generally speaking, and in accordance with the present invention a biofeedback system including an elongated member, for feeding back sounds indicative of swing tempo of the elongated member is provided. In a preferred embodiment, the system comprises a plurality of acceleration measuring devices adapted to measure accelerations at a plurality of locations along the elongated member; a first microcontroller for processing the measured acceleration signals to reduce effects of gravity and forming a digital number related to an angular rotational speed raised to a power; said digital number comprising a plurality of bits; a second microcontroller for receiving the digital number and associating the bits with a plurality of groups each having an associated tonal composition and amplitude value indicative of bit content and for forming commands indicative of the tonal composition and amplitude value; and a synthesizer responsive to the commands and producing an audio signal; and means for outputting the audio signal.

In another preferred embodiment, the present invention comprises the steps of generating a plurality of acceleration signals indicative of the acceleration of the elongated member at different locations thereof; processing the acceleration signals to reduce the contribution of gravity; forming a sequence of digital samples of the processed acceleration signals, each sample comprising a plurality of bits related to an angular rotational speed raised to a power; defining groups of the plurality of bits in a sample, each group having an associated tonal composition and amplitude value related to a group's digital value; generating commands for the synthesis of sounds representative of the tonal composition and amplitudes of the groups; and feeding back synthesized sounds.

In yet a further embodiment, the system of the present invention comprises a plurality of sensors coupled to the elongated member for deriving digital signals indicative of motion of the elongated member; means for processing the signals to reduce the effect of gravity, generating a multi-bit digital number indicative of an angular velocity raised to a power and associating the bits into a plurality of groups each having an associated tonal composition and amplitude indicative of bit content and for forming commands indicative of the tonal composition and amplitude value; a synthesizer responsive to the commands for producing audio signals; and means for outputting the audio signals.

In an alternative methodology, the present invention comprises the steps of providing a plurality of sensors mounted along the elongated member for deriving digital signals indicative of motion of the elongated member; processing the signals to eliminate or reduce an effect of gravity, generating a multi bit digital number indicative of the angular velocity raised to a power at at least two positions along the elongated member, and mapping the bits into a plurality of groups each having an associated tonal composition and an amplitude indicative of bit content; synthesizing a sound signal having the tonal composition associated with a group and amplitude indicative of the bit value of the group; and outputting the audio signal.

In still yet another embodiment, a biofeedback system for converting motion characteristics of the elongated member into sounds is provided and comprises a plurality of sensors to capture motion parameters of the elongated member as multi-bit digital numbers; a processor to map the bits of each of the numbers into a plurality of groups each having an associated tonal composition and an amplitude indicative of bit content; a synthesizer for generating an audio signal responsive to the mapped bits; and means for outputting the audio signal. In a related methodology, the present invention comprises the steps of providing a plurality of sensors to capture motion parameters of the elongated member as multi-bit digital numbers; mapping the bits of each of the numbers into a plurality of groups each having an associated tonal composition and an amplitude indicative of bit content; synthesizing a sound signal responsive to the mapped bits to produce a signal having the tonal composition associated with a group and amplitude indicative of bit content; and outputting the signal.

In a specific embodiment, the elongated member is a golf club.

BRIEF DESCRIPTION OF THE DRAWINGS

While all features may not be labeled in each Figure, all elements with like reference numerals refer to similar or identical parts.

DETAILED DESCRIPTION OF THE PREFERRED EMBODIMENTS

Figure 1:
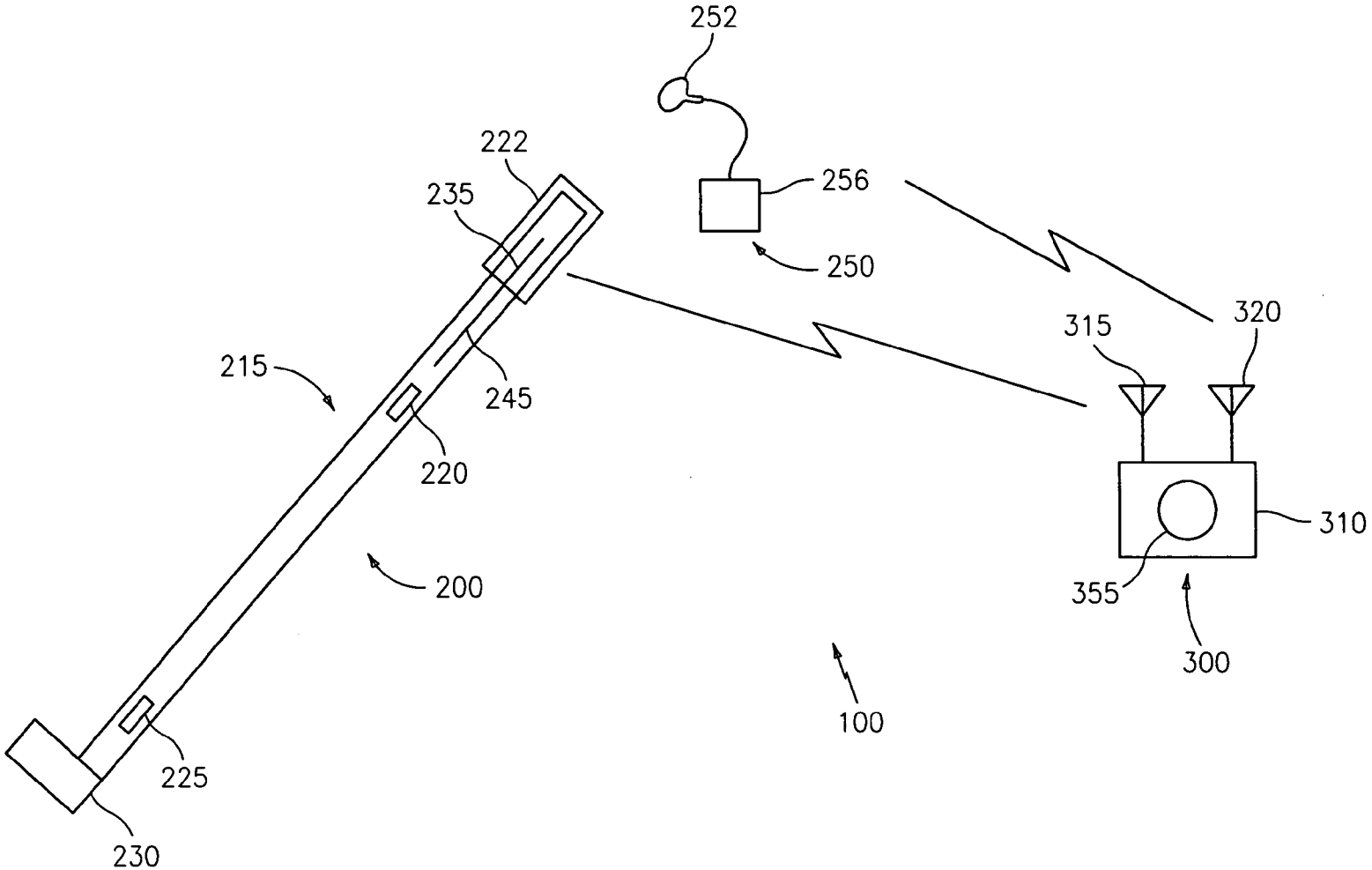
FIG. 1 is an illustration of a biofeedback system constructed in accordance with the present invention.
Figure 2:
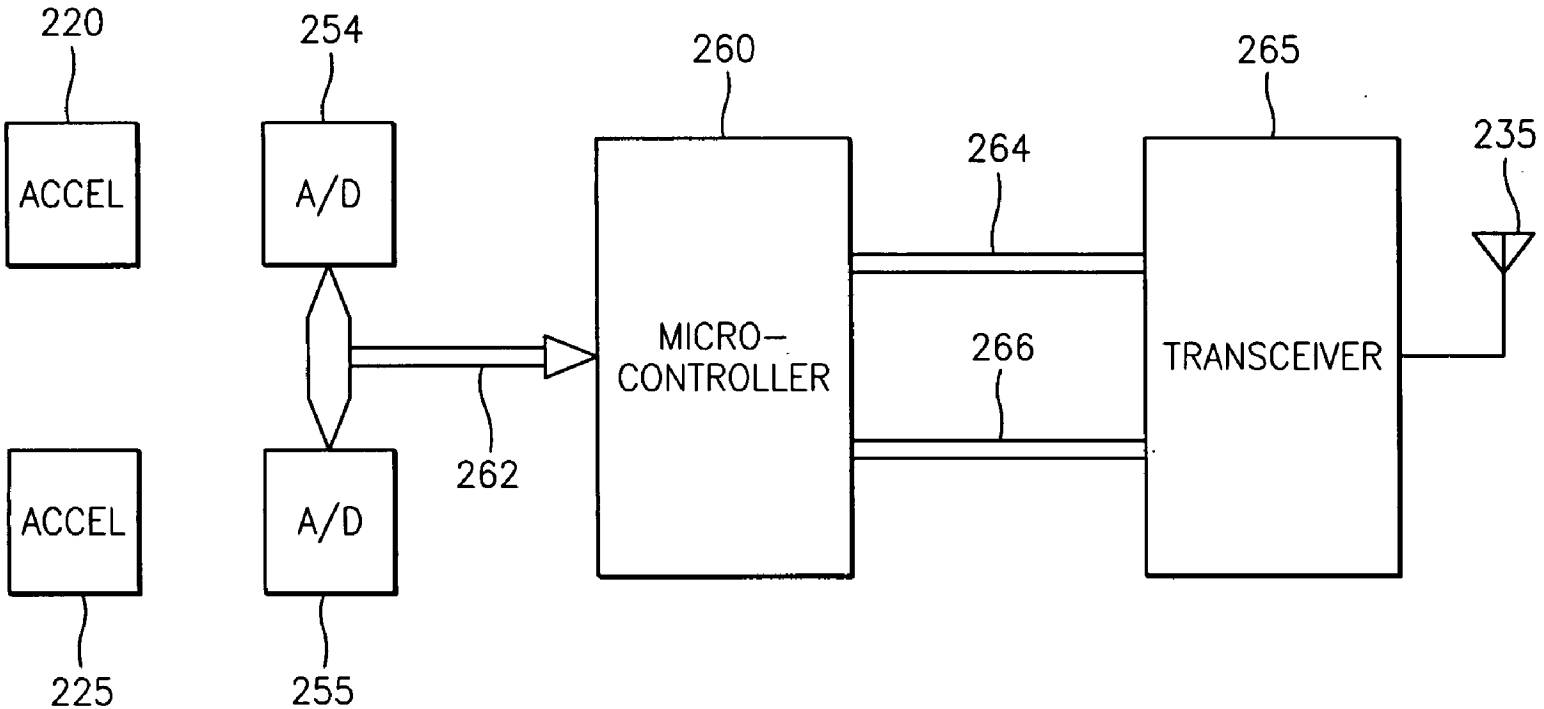
FIG. 2 is a block diagram of the electronics located in a golf club of a preferred embodiment of the present invention.

Reference is first made to FIGS. 1 and 2 wherein a biofeedback system constructed in accordance with the present invention is shown at 100 and a golf club constructed in accordance with the present invention and generally indicated at 200, is disclosed. As the present invention is also directed to a system for providing audio biofeedback, along with the golf club at 200, system 100 preferably comprises a processor unit, generally indicated at 300 and a monitor generally indicated at 250, both of which in the preferred embodiment are wirelessly coupled to each other and/or club 200.

The golf club at 200 comprises an elongated member, generally indicated at 215, which itself comprises at least a shaft and may additionally comprise a clubhead 230. A first accelerometer 220 and a second accelerometer 225 are coupled to member 215. Upon a swing of the elongated member 215, accelerometers 220 and 225 monitor acceleration along the axis of member 215. Preferably located in member 215 is additional circuitry, generally indicated at 245, comprising two (2) A/D converters 254 and 255 respectively operatively coupled to accelerometers 220, 225, a microprocessor 260 coupled to converters 254, 255 and a wireless transceiver 265 coupled to the output of microcontroller 260. Microprocessor 260 takes the difference of the digitized outputs of accelerometers 220 and 225 and transmits the information to processor unit 300 via antenna 235. To be clear, an accelerometer provided in the club head is still deemed to be an accelerometer along the elongated member.

Processor 300 receives the transmitted data via an antenna 315 and, after sonifying the signal as discussed below, outputs a biofeedback audio signal to speaker 355 or monitor 250 in a known manner. Monitor 250 may comprise an earpiece 252 and a belt/pocket mounted receiver 256. In an alternate embodiment, an integrated receiver and headset may be worn by the user.

Figure 3:
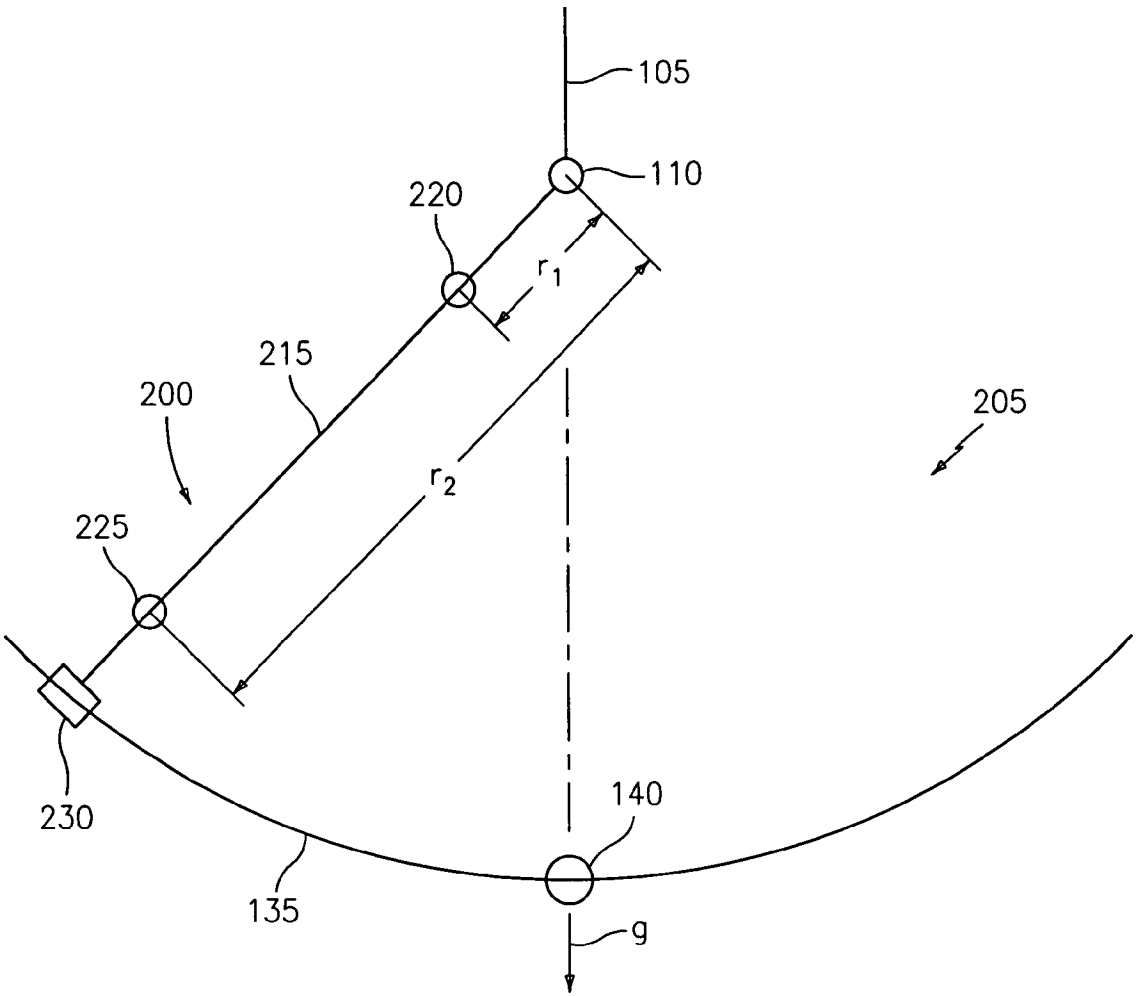
FIG. 3 is a sketch used in an analysis of a golf swing using a golf club, but which is equally applicable in the analysis of a swing of any elongated member, such as a tennis racket for example.

By way of general background, reference is now made to FIG. 3 at 205 wherein swing analysis parameters are depicted and golf club 200, with accelerometers 220 and 225 having their measurement axis aligned with the axis of the golf club, is shown. A player (not shown), having arms indicated at 105 and wrists indicated at 110, is swinging club 200 with head 230 in a circular motion 135 around wrists 110 with an angular velocity of ω radians per second in an attempt to hit ball 140.

The centripetal acceleration at a particular point on the swinging club can be measured with an accelerometer at the point of interest and whose sensing axis is aligned along the axis of the member. In general, this centripetal acceleration, $a_c$, can be used to yield an instantaneous measurement of the angular speed of the club through the relation $a_c=\omega^2 r$, where ω is the angular velocity of the club head (assuming the accelerometer at or near the head) and r is the effective radius through which the accelerometer is moving.

To estimate the maximum magnitude of this acceleration, it has been noted that a player can achieve club heads speeds on the order of 100 mph. The typical radius defining the circular motion on which the club head moves is on the order of 5 feet but an accelerometer would typically be located at about the 4.5 foot position. This yields a maximum measured centripetal acceleration on the order of 1200 $m/s^2$. It is more conventional to normalize by the gravitational acceleration 9.8 $m/s^2$, yielding approximately 120 g. This is useful as a means of defining the necessary dynamic range of the measurement.

A measurement error is due to the influence of gravity. The accelerometer measures all accelerations it experiences along its sensing axis. The gravitational pull of earth yields a constant acceleration of 9.8 $m/s^2$, which is denoted as 1 g and directed towards the center of the earth. The direction of the gravitational acceleration is denoted by arrow "g", which defines vertical for the invention.

As shown in FIG. 3, the orientation of golf club 200 with respect to the direction of gravitational acceleration g changes as the club head 230 moves along path 135. This changing orientation causes a time varying error signal related to the gravitation acceleration to appear at the outputs of accelerometers 225 and 220.

The error signal, which can be confused with the desired centripetal acceleration signal, is eliminated by making a differential measurement using data from accelerometers 220 and 225 located respectively at $r_1$ and $r_2$. As one skilled in the art would recognize, each accelerometer senses identical gravitational acceleration but the centripetal acceleration scales as the effective radius of motion. Summarizing this statement, $$a_1=\omega^2 r_1+\vec{g}\cdot\hat{r} \tag{1}$$

where $a_1$ is the acceleration measured at accelerometer 220; and $$a_2=\omega^2 r_2+\vec{g}\cdot\hat{r} \tag{2}$$

where $a_2$ is the acceleration measured at accelerometer 225. Note that $\vec{g}\cdot\hat{r}$ indicates the magnitude of the gravitational acceleration along the axis of the member. Taking the difference of equations (1) and (2) yields;

$$a_2-a_1=\omega^2(r_2-r_1), \tag{3}$$

which is proportional to $\omega^2$ (i.e. the angular velocity squared) and independent of the gravitational acceleration, while $(r_2-r_1)$ is a fixed number.

It is clear from Equation 3 that maximizing the separation between the two accelerometers optimizes the resulting signal. This suggests placing one accelerometer at or near the grip end and another at or near the head end which is set forth in the preferred embodiment.

Figure 4:
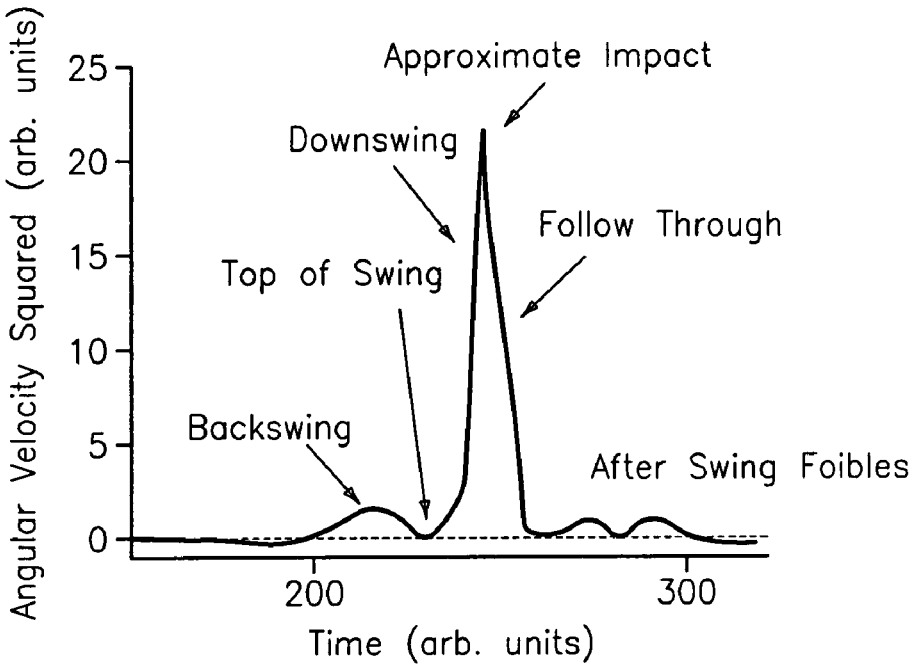
FIG. 4 is a typical plot of angular velocity squared for the configuration of FIG. 3.
Figure 5:
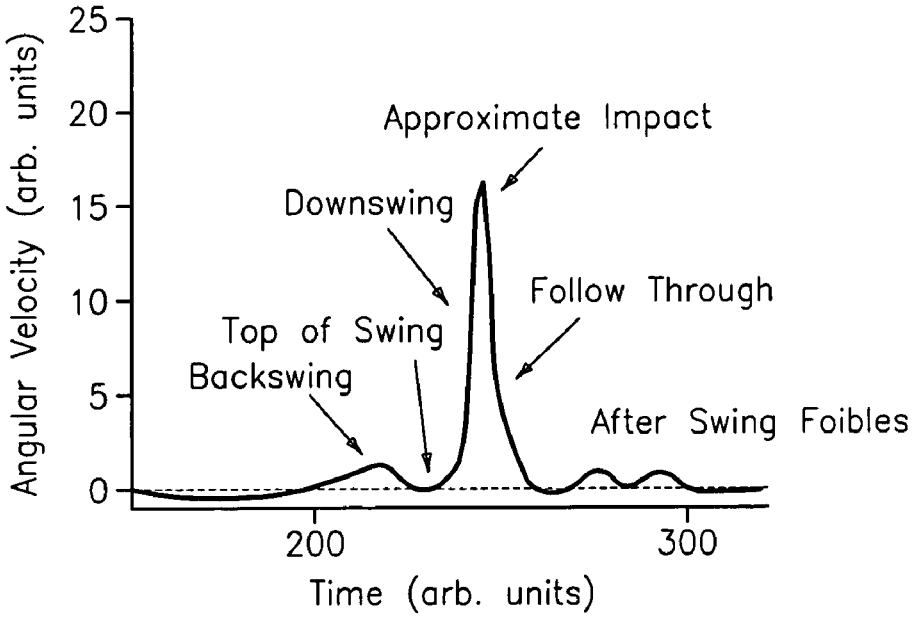
FIG. 5 is a typical plot of angular velocity for the configuration of FIG. 3.

A typical plot of an $\omega^2$, an angular velocity squared signal, is shown in FIG. 4. The square root of the signal in FIG. 4, which is ω, the angular velocity, is shown in FIG. 5. A study of FIGS. 4 and 5 show that the use of an $\omega^2$ signal yields improved sensitivity and greater output level changes for swing speed changes. We note that $\omega^2$ is also a measure of the rotational kinetic energy of a club.

The present invention sonifies the $\omega^2$ signal by mapping or associating the bits in a 12 bit digital representation of the substantially instantaneous acceleration difference value into intervals or groups of bits and giving each group its own "sound"; one or more instruments playing chords or notes. Providing each group with its own sound and varying the amplitude of each sound as a function of the value of the bits in the group adds information to the audio biofeedback signal and aids in discerning tempo. The overall effect is a changing tonal composition and volume while maintaining harmonic relationships and avoiding frequency chirp.

The preferred embodiment of the present invention uses a MIDI Wavetable Generator to generate the unique sounds for the chosen groups.

Referring again to FIGS. 1 and 2, it can be seen that accelerometer 225 reads the higher of the two centripetal accelerations, as it is located nearer club head 230. The analog outputs of the accelerometers are fed to A/D converters 254 and 255 where they are converted into digital data streams and fed via serial link 262 to microprocessor 260 for processing. The preferred embodiment includes Microchip MCP3201 12 bit A/D converters to convert the analog output of the accelerometers to a digital data stream fed to microprocessor 260, which preferably is a Microchip 8 bit microcontroller, the PIC 16F873A.

Microprocessor 260 performs subtraction of the accelerometer readings and formats the resulting 12 bit NRZ data for transmission to processor 300 by transceiver 265. In alternate embodiments the subtraction operation is performed in processor 300.

Transceiver 265 is preferably a Chipcon CC1000 configured to receive the NRZ serial data from microprocessor 260, reformat the data into synchronous Manchester coding and feed antenna 235 at 915 MHZ. Initialization values, which include data formatting, frequency selection, etc. are stored in flash memory in microprocessor 260 and fed to transceiver 265 by serial link 266. Acceleration data from microcontroller 260 is sent to transceiver 265 by serial link 264.

Selection of a suitable accelerometer for the preferred embodiment proceeds as follows. As noted above, with a typical radius defining the circular motion on the order of 5 feet, a club head speed on the order of 100 mph, and an accelerometer mounted at about 4.5 feet from the grip end of member 215, an acceleration by accelerometer 225 would experience an acceleration of approximately 1200 $m/s^2$ or approximately 120 g. Therefore, the preferred accelerometers are those having a g range of 120 g's, such as the Analog Devices ADXL 193 (AD 22282). In an alternate embodiment for golfers with significantly faster swings, accelerometers having a g range of 250 g's, such as an ADXL 193 (AD22282), may be utilized, and in a third embodiment for golfers with relatively slow swings, accelerometers having a g range of 50 g's, such as the ADXL 78 (AD22280), may be used. In an alternative embodiment, accelerometer 220 may have a rating lower than that of accelerometer 225 because accelerometer 220 is closer to grip 222 and will therefore experience centripetal accelerations lower that that experienced by accelerometer 225. For this latter embodiment the output of accelerometer 220 would preferably be scaled to facilitate the subtraction of equations (1) and (2) to give equation (3).

Alternatively, a plurality of accelerometers of the foregoing types may be provided and selectable by a switch (not shown) on club 200, thus allowing the same club to be used by different golfers having greatly different swing speeds or the same golfer under conditions requiring greatly different swing speeds. In another embodiment, selection of the accelerometer may be performed by a wireless radio link between transceiver 265 and transceiver 330.

Figure 6:
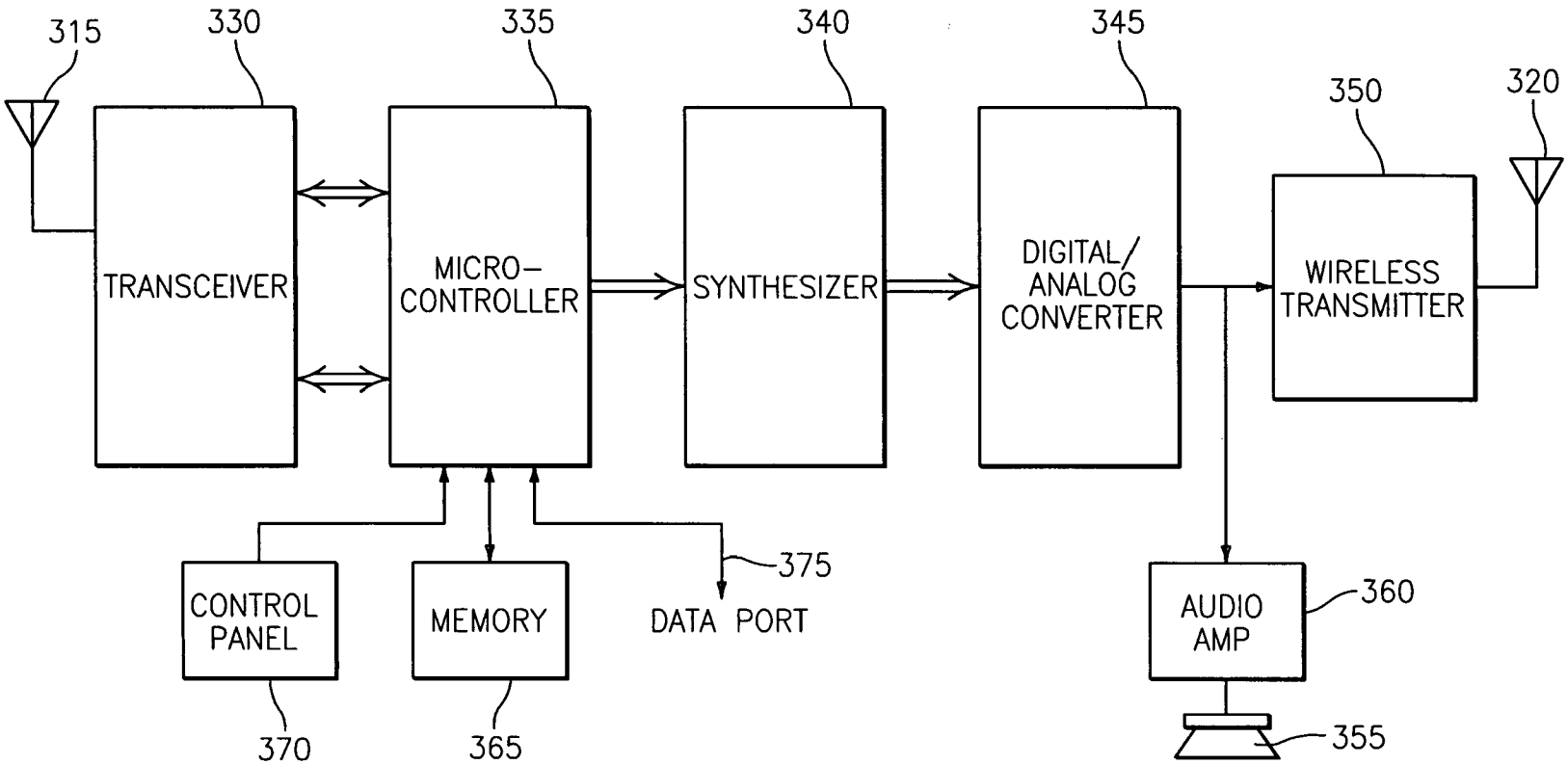
FIG. 6 is a block diagram of a processor portion of a preferred embodiment of the present invention.

FIG. 6 is a block diagram of the circuits in processor 300. The 12 bit data transmitted by transceiver 265 and antenna 235 is received by antenna 315 and demodulated back to NRZ code by transceiver 330 and fed to microcontroller 335 via a NRZ serial stream. Serial busses 332 and 334 provide communications between blocks 330 and 335, serial bus 337 provides communications between blocks 335 and 340, and bus 342 provides communications between blocks 340 and 345.

Microcontroller 335 which is preferably a PIC 16F873A, receives the 12 bit digital data stream and maps the bits of the 12 bit acceleration signal into 6 Groups; groups 1–4 have 9 bits while Group 5 includes 8 bits and Group 6 includes 7 bits. The bits that define each group in the preferred embodiment are shown in Table 1.

TABLE 1

| Group | Defining Bits |
|---|---|
| 1 | $b_8$–$b_0$ |
| 2 | $b_9$–$b_1$ |
| 3 | $b_{10}$–$b_2$ |
| 4 | $b_{11}$–$b_3$ |
| 5 | $b_{11}$–$b_4$ |
| 6 | $b_{11}$–$b_5$ |

The bits in each group are treated as a word and microcontroller 335 calculates the numerical value of the word. For example if the "word" $b_8$–$b_0$ had the value 000001010, the value of the word would be 10.

For groups having non zero word values, microcontroller 335 preferably transmits MIDI commands to synthesizer 340 to turn "ON" the tone(s) for a particular group and commands an amplitude for "ON" group equal to a value proportional to the word value of the group. The MIDI commands thus generated are serially communicated to synthesizer 340. Synthesizer 340 interprets the MIDI commands and converts them into biofeedback signal values as discussed in further detail below. The preferred embodiment uses using a CRYSTAL Single Chip Wavetable Music Synthesizer CS9236 that is General MIDI compliant. In an alternate embodiment tonal groups are prerecorded, recalled from memory and combined to form a synthesized biofeedback signal.

In the preferred embodiment, synthesizer 340 is programmed by microcontroller 335 to associate each group with a particular MIDI channel. Each MIDI channel is programmed to play a particular chord which in the preferred embodiment, includes two notes known musically as fifths and includes a "root" and its perfect "fifth". When using fifths with a base frequency of $f_0$, the related fifth is of frequency 1.5 $f_0$. Other harmonic relationships are switch selectable by the panel control 370 in FIG. 6. Moreover alternative embodiments may utilize sets of notes with different harmonic relationships and/or sets of notes that are not harmonically related. The preferred instrument for all groups is a rock organ, although another instrument for all groups or different instruments for each group are selectable by the panel control 370.

The note-group relationship or tonal composition for the preferred embodiment is shown in Table 2 where C4 is middle C (approx. 261.6 Hz), C3 is an octave below (approx. 130.8 Hz) and C5 is an octave above (approx. 523.2 Hz) middle C, etc.

TABLE 2

| | MIDI | Root | | Fifth | |
|---|---|---|---|---|---|
| Group | Channel | Frequency | Note | Frequency | Note |
| 1 | 1 | $f_0$ | C3 | 1.5 $f_0$ | G3 |
| 2 | 2 | 2 $f_0$ | C4 | 3 $f_0$ | G4 |
| 3 | 3 | 3 $f_0$ | G4 | 4.5 $f_0$ | D5 |
| 4 | 4 | 4 $f_0$ | C5 | 6 $f_0$ | G5 |
| 5 | 5 | 5 $f_0$ | E5 | 7.5 $f_0$ | B6 |
| 6 | 6 | 6 $f_0$ | G5 | 9 $f_0$ | D6 |

Figure 7:
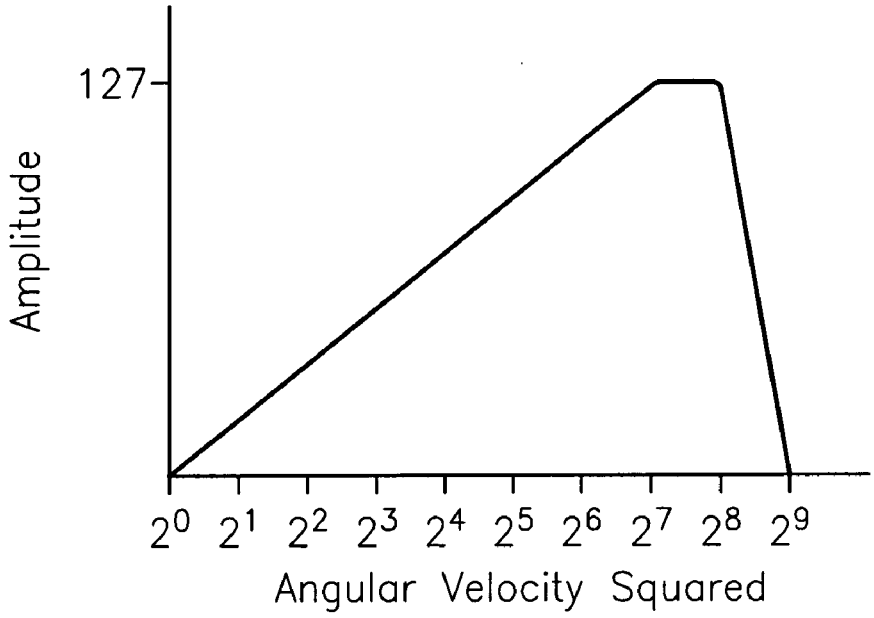
FIG. 7 is plot of an amplitude characteristic of a single tonal group.

The amplitude (volume) of each MIDI channel is determined by the bit value of the corresponding group. For example, in Group 1, the volume is defined by bits $b_8$–$b_0$ of the 12-bit full-scale signal, where $b_0$ is the least significant bit. When the word value of bits $b_8$–$b_0$ is between 0 and 127, the output volume is set proportional to the word value. When the value is between 128 and 255, the output volume is limited to a value proportional to 127. When the value is between 256 and 511, the output volume is set equal to (511—word value of bits in the group)/2. This yields a waveform for Group 1, for example, that increases with angular acceleration squared until a maximum value of 127, stays at 127 then has a negative slope and decreases back down to zero as angular acceleration squared increases further. This amplitude characteristic is shown in FIG. 7.

Figure 8:
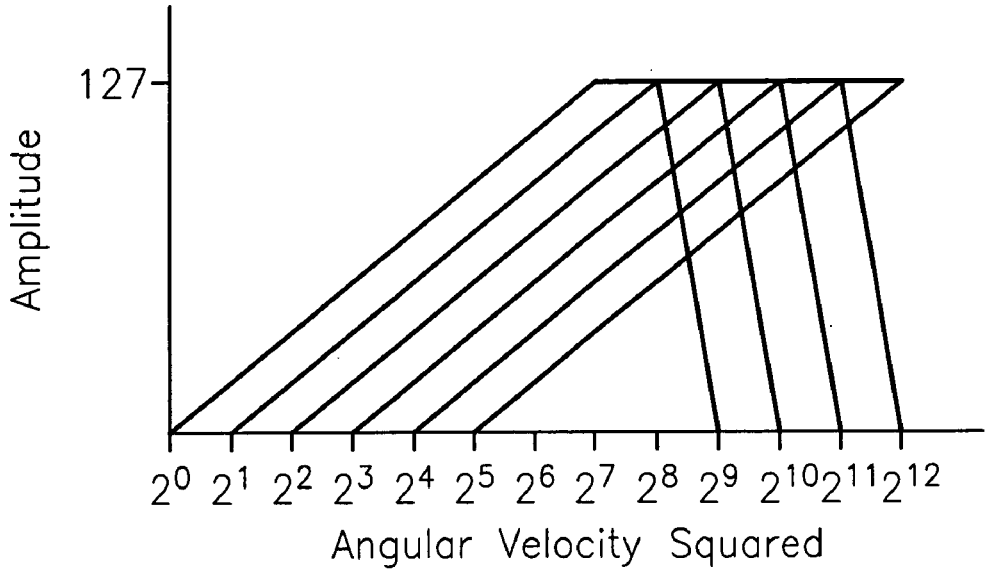
FIG. 8 is a plot of amplitude characteristics for all tonal groups used to represent 12 bit digital data of the present invention.

This basic process is the same for all groups. Since each of Groups 1–4 is defined by 9 bits each of their respective amplitude curves will follow that shown in FIG. 7. Since Group 5 is defined by 8 bits and Group 6 by 7 bits, their respective amplitude characteristics will reach 127 but not reverse direction and have a negative slope. The resulting orchestration of pitch and volume for all Groups is shown in FIG. 8. The net effect is a changing volume and tonal content with increasing signal in a format that can maintain harmonic relationships and avoid frequency chirp.

While Table 2 shows each chord associated with a particular channel, alternate embodiments provide multiple chords on one or more channels.

Processor 300 includes flash memory 365 for storing the sonified data (in the form of MIDI Commands and 12 bit acceleration data). The former is preferably used for playback during a practice session while the 12 bit acceleration data may be used in conjunction with a home computer in lieu of processor 300 or for experimentation with alternate sound and sonification effects.

Information may be downloaded from processor 300 via data port 375 or, in an alternative embodiment, by removing a memory card. Likewise, at the player's option, alternative sonification schemes can be uploaded to processor 300 via data port 375 and selectable via control panel 370.

The output of synthesizer 340 is a digital data stream representing the sonified angular velocity squared signal and a measure of the rotational kinetic energy of the club. This signal is fed to D/A converter 345 for conversion to an analog value. This analog value is fed to audio amplifier 360 and fed to speaker 355. The analog signal from D/A converter 345 is also available at a connector (not shown) which optionally connects to wireless transmitter 350 having antenna 320. Wireless transmitter 350 uses transmissions via radio waves but in an alternate embodiment infra-red signals are used.

In yet another feature of the present invention, golf swing curves having the general form of FIG. 4 may be superimposed or otherwise compared to each other to give a visual indication (and comparison) of swing tempo among repeated swings of a single user or among various users. Such information can thereafter be stored for later review and/or visually communicated, for example, to a user at home. In this way, a user may be able to analyze the golfswing(s) of professionals, for example, who are using the golf club 200 of the present invention.

It can thus be seen that the present invention provides numerous advantages not found in the prior art. For example, the present invention provides audio feedback using sonified angular velocity squared values, correction of the angular velocity squared values for the acceleration of gravity and the use of changing tonal composition and amplitude, rather than swept frequencies, to indicate tempo.

While the invention has been particularly shown and described with respect to preferred embodiments thereof, it will be understood by those skilled in the art that changes in form and details may be made therein without departing from the scope and spirit of the invention. For example, all the microprocessor functions could be provided in one unit if the microprocessor has the needed speed, etc. for carrying out the methodology and functions set forth above. Therefore, the distribution of components as set forth above are exemplary and not in a limiting sense. In a similar manner, all references to the power to which the angular rotational speed is raised is noted as 2, but should someone slightly vary this quantity, the claims should not be so limiting, and therefore noted herein as at least substantially (although preferably exactly) 2. Additionally, it should be understood that acceleratometers placed along the elongated member can be placed in or on the member, both of which are covered by the claims herein. Lastly, it is likewise conceivable that sensors are used which are not physically mounted on the member, such as on a wall, for example, and the rights are hereby reserved to provide claims to such an embodiment where the acceleration of the elongated member is measured from one or more physically separated sensors.

What invention claimed is:

1. A biofeedback system including an elongated member, for feeding back sounds indicative of swing tempo of the elongated member, the system comprising:

a plurality of acceleration measuring devices adapted to measure accelerations at a plurality of locations along the elongated member;

a first microcontroller for processing the measured acceleration signals to reduce effects of gravity and forming a digital number related to an angular rotational speed raised to a power;

said digital number comprising a plurality of bits;

a second microcontroller for receiving the digital number and associating the bits with a plurality of groups each having an associated tonal composition and amplitude value indicative of bit content and for forming commands indicative of the tonal composition and amplitude value; and a synthesizer responsive to the commands and producing an audio signal; and means for outputting the audio signal.

2. The system as claimed in claim 1, wherein the power to which the angular rotational speed is raised is at least substantially 2.

3. The system as claimed in claim 1, wherein the elongated member is a golf club.

4. A method of feeding back synthesized sounds indicative of swing tempo of an elongated member, the method comprising the steps of:

generating a plurality of acceleration signals indicative of the acceleration of the elongated member at different locations thereof;

processing the acceleration signals to reduce the contribution of gravity in the signals;

forming a sequence of digital samples of the processed acceleration signals, each sample comprising a plurality of bits related to an angular rotational speed raised to a power;

defining groups of the plurality of bits in a sample, each group having an associated tonal composition and amplitude value related to a group's digital value;

generating commands for the synthesis of sounds representative of the tonal composition and amplitudes of the groups; and feeding back synthesized sounds.

5. A biofeedback system including an elongated member for feeding back sounds indicative of swing tempo of the elongated member, the system comprising:

a plurality of sensors coupled to the elongated member for deriving digital signals indicative of motion of the elongated member;

means for processing the signals to reduce an effect of gravity, generating a multi-bit digital number indicative of an angular velocity raised to a power and associating the bits into a plurality of groups each having an associated tonal composition and amplitude indicative of bit content and for fanning commands indicative of the tonal composition and amplitude value;

a synthesizer responsive to the commands for producing audio signals; and means for outputting the audio signals.

6. The system as claimed in claim 5, wherein the power to which the angular rotational speed is raised is at least substantially 2.

7. The system as claimed in claim 5, wherein the elongated member is a golf club.

8. A method of feeding back sounds indicative of swing tempo of an elongated member, the method comprising the steps of:

providing a plurality of sensors mounted along the elongated member for deriving digital signals indicative of motion of the elongated member;

processing the signals to eliminate or reduce an effect of gravity, generating a multi bit digital number indicative of the angular velocity raised to a power at at least two positions along the elongated member, and mapping the bits into a plurality of groups each having an associated tonal composition and an amplitude indicative of bit content;

synthesizing a sound signal having the tonal composition associated with a group and amplitude indicative of the bit value of the group; and outputting the audio signal.

9. A biofeedback system for converting motion characteristics of an elongated member into sounds, the biofeedback system comprising:

a plurality of sensors positioned along the elongated member to capture motion parameters as multi-bit digital numbers;

a processor to map the bits of each of the numbers into a plurality of groups each having an associated tonal composition and an amplitude indicative of bit content;

a synthesizer for generating an audio signal responsive to the mapped bits; and means for outputting the audio signal.

10. A method for providing biofeedback signals to a user using sensors to capture motion characteristics of an elongated member, the meted comprising:

providing a plurality of sensors positioned along the elongated member for capturing motion parameters thereof as multi-bit digital numbers;

mapping the bits of each of the numbers into a plurality of groups each having an associated tonal composition and an amplitude indicative of bit content;

synthesizing a sound signal responsive to the mapped bits to produce a signal having the tonal composition associated with a group and amplitude indicative of bit content; and outputting the signal.

* * * * *

UNITED STATES PATENT AND TRADEMARK OFFICE

CERTIFICATE OF CORRECTION

PATENT NO. : 7,160,200 B2
APPLICATION NO. : 10/948374
DATED : January 9, 2007
INVENTOR(S) : Robert D. Grober It is certified that error appears in the above-identified patent and that said Letters Patent is hereby corrected as shown below:

Title page, item [57]
ABSTRACT

Line 9, delete "said" and replace it with --the--

Column 12

Line 9, delete "meted" and replace it with --method--

Signed and Sealed this

Twenty-seventh Day of March, 2007

JON W. DUDAS
*Director of the United States Patent and Trademark Office*